United States Patent [19]

Staats

[11] 4,164,309

[45] Aug. 14, 1979

[54] DOCUMENT STORAGE AND ACCESS CASE

[76] Inventor: David K. Staats, 124 Mohawk, Clarendon Hills, Ill. 60514

[21] Appl. No.: 776,718

[22] Filed: Mar. 11, 1977

Related U.S. Application Data

[63] Continuation-in-part of Ser. No. 595,487, Jul. 14, 1975, abandoned.

[51] Int. Cl.[2] ..... B65D 71/00

[52] U.S. Cl. ..... 224/45 R; 206/508; 312/193

[58] Field of Search ..... 224/45 R, 48 R; 206/73, 206/508, 505; 220/22.1, 22, 22.3; 312/183, 193

[56] References Cited

U.S. PATENT DOCUMENTS

| | | | |
|---|---|---|---|
| 1,785,815 | 12/1930 | Kurtz, Jr. | 206/73 |
| 2,665,808 | 1/1954 | McAlister | 206/73 |
| 3,419,184 | 12/1968 | Asenbauer | 206/508 |
| 3,754,646 | 8/1973 | Henig | 206/73 |
| 3,759,416 | 9/1973 | Constantine | 206/508 |
| 3,850,296 | 11/1974 | Hirata et al. | 206/73 |
| 3,856,137 | 12/1974 | Brindley | 206/73 |

*Primary Examiner*—Trygve M. Blix
*Assistant Examiner*—Kenneth W. Noland
*Attorney, Agent, or Firm*—Dressler, Goldsmith, Clement, Gordon & Shore, Ltd.

[57] ABSTRACT

A document storage and access case for a plurality of groups of documents including a housing in which are disposed a plurality of inclined ramps and document supports associated therewith. The ramps may be formed as an integral part of the housing or as an insert and each group of documents rests on a ramp to be individually gripped and tilted to a forward leaning relatively stable position for providing access to remaining documents of the group. Ledges are provided for supporting selected documents at a changed orientation to identify selected locations within a group of documents.

65 Claims, 19 Drawing Figures

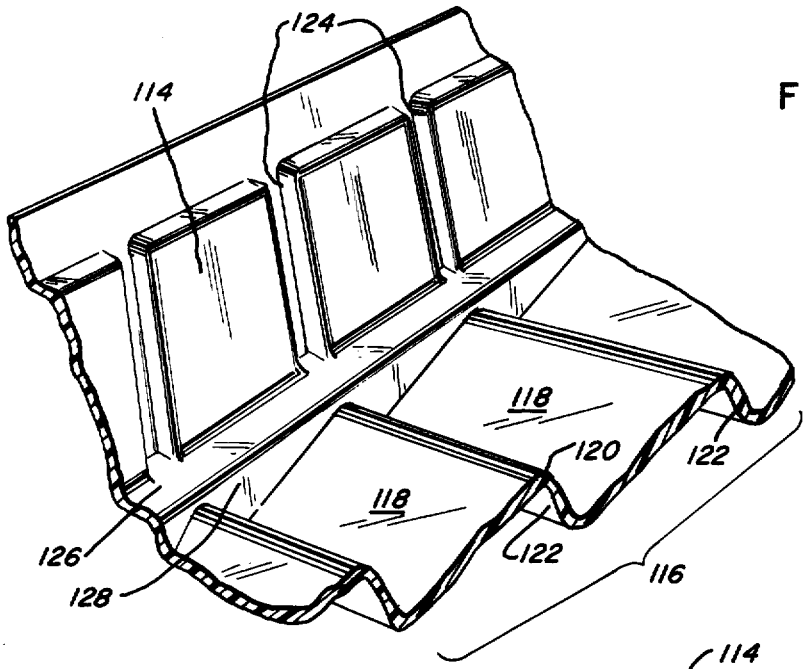
FIG. 7
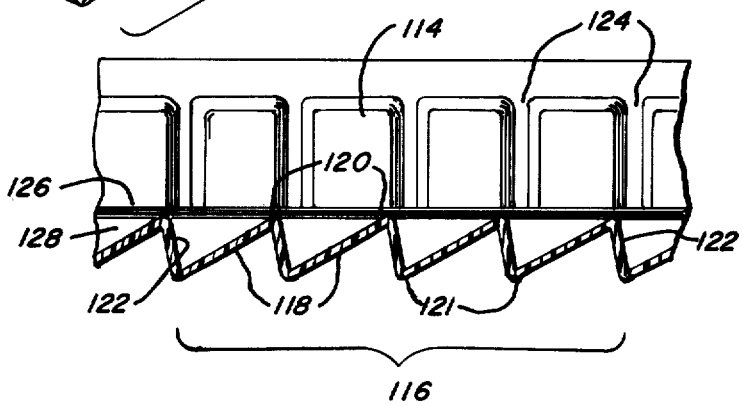
FIG. 8
FIG. 9
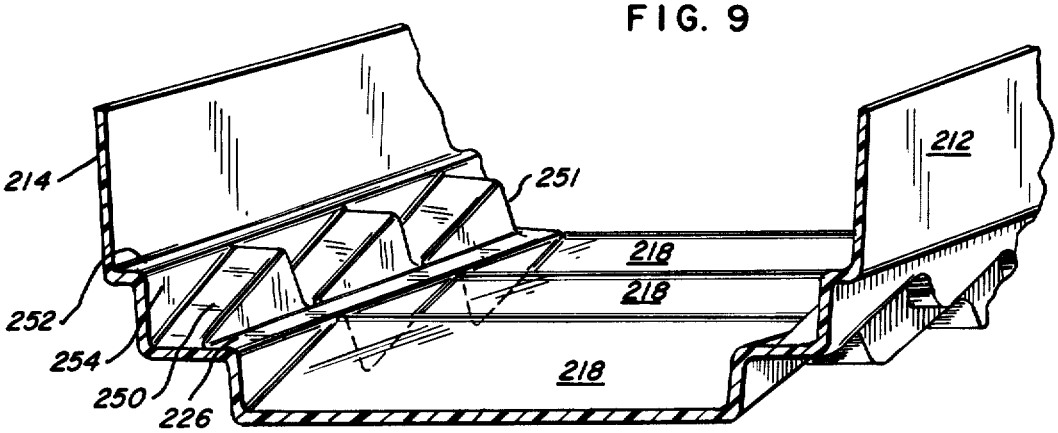

400
402
404
406
408
410
412
414
416
418
420
422
424
426
428
430
432
434
436
444
446
448
450
452
453
454
456
458
460
462

DOCUMENT STORAGE AND ACCESS CASE

BACKGROUND OF THE INVENTION

This application is a continuation-in-part of my copending application Ser. No. 595,487, filed July 14, 1975 now abandoned.

The present invention relates to document storage and access cases, and more specifically to such cases utilized to store and facilitate access to documents of uniform size such as those containing microfilm, e.g., microfiche and aperture cards.

Documents such as microfiche and aperture cards and others having sufficient body to be stored on edge are typically housed in containers such as card files, file boxes, file drawers and the like. Documents placed in such containers rest on generally flat bases which makes access to the documents difficult, particularly in the case of documents of uniform size. As a result, it is often a problem to locate a desired individual document, and the documents frequently pinch together compounding the difficulty of locating a particular document and of indicating the location from which a document has been removed.

The deficiencies of existing structures for documents such as microfiche and aperture cards have been recognized, and various techniques for improving access to individual documents and for indicating the location of a document being removed are promoted. None of these approaches are particularly satisfactory, in spite of the fact they are often expensive, and they do not possess any degree of flexibility in use.

For example, one type of file box being marketed by LUXOR CORPORATION of Waukegan, Illinois, under the trademark "fiche-Saf" is basically a file box provided with slots formed in the sidewalls into which one corner of a document may be placed to alter its orientation and indicate a position of a removed document. However, this clearly is not satisfactory since that unit is also marketed with "file out" cards for indicating document removal. The configuration is not satisfactory in that there are only a few slots spaced along only a part of the length of the file drawer and therefore only documents in relatively few positions can make use of the slots.

Other structures such as those marked by The Holmberg Company, Inc., of Minneapolis, Minn., Business Efficiency Aides, Inc., of Skokie, Illinois, and Visu-Flex Company of Orange, Calif., all promote the concept of "fan storage" to facilitate access to stored documents such as microfiche. Other structures such as those marketed by Ring King Visibles, Inc., of Muscatine, Iowa, incorporate slotted cards or pages adapted to receive a document in each slot with the upper edge of the document being visable above the edge of the slot.

While the structures referred to above may not be completely unsatisfactory, the increasing use of documents such as microfiche and aperture cards require storage and access cases which provide improved access to the stored documents which facilitate identification of locations of removed documents, which provide increased flexibility, and which can be portable.

SUMMARY OF THE INVENTION

In accordance with the present invention, there are provided document storage cases which eliminate the deficiencies of existing structures by providing improved access to documents stored, by providing convenient means for identifying the position of a document when located and the position from which a document has been removed, while at the same time exhibiting flexibility for use with documents of different sizes and convenient portability.

In accordance with one aspect of the present invention, there is disclosed a document storage and access case having a housing incorporating a plurality of inclined ramps each for supporting a group of uniformly sized documents to provide accessability to individual ones of the documents of each group. The surfaces of the inclined ramps may be configured to inhibit document slippage and pinching together.

The documents rest against document supports which, for example, may be secured to risers interconnecting adjacent ramps, or alternatively which may be releasably supported adjacent the risers, for example, by slots formed in the sidewalls of the housing.

Cases incorporating the present invention may also include shelf or ledge portions disposed adjacent to the sidewalls of the housing so that the location of a document can be indicated simply by placing one corner of the document on a ledge, thereby orientating the document at a different angle from its orientation when resting entirely on one of the inclined ramps.

Document storage cases in accordance with the present invention may simultaneously or alternatively accommodate groups of documents of different sizes, for example, microfiche and/or aperture cards. In one embodiment, a removable spacer box is positioned adjacent to one sidewall and is releasably retained in place. When the spacer box is in place, the housing accommodates microfiche cards. Upon removal of the spacer box, the housing can accommodate aperture cards.

In another embodiment, microfiche, which are narrower in width than aperture cards, are supported on the inclined ramps, and aperture cards can be supported on the ledges disposed between the ramps and the sidewalls of the housing. Additional ledges may be provided so that the orientation of the aperture cards can also be altered to indicate a desired location.

The ledges themselves may incorporate inclined ramps so that the documents supported thereon can be divided into groups for improved access in accordance with the present invention.

In another embodiment, a recess is provided in the ramps and each document support has a downward projection which is receivable in the recess. The document support can be tilted forward from a rearwardly leaning stable position in which the front end of the recess and one of the risers engage the document support and cooperate to retain the document support in the stable position and prevent it from sliding along the ramp.

Numerous other advantages and features of the present invention will become readily apparent from the following detailed description of the invention and of one embodiment thereof, from the claims and from the accompanying drawing in which each and every detail shown is fully and completely disclosed as a part of this specification in which like numerals refer to like parts.

BRIEF DESCRIPTION OF THE DRAWING

FIG. 7 is an enlarged fragmentary perspective view of the embodiment of FIG. 6;

FIG. 8 is a fragmentary elevation, partially in section, of the embodiment of FIG. 6;

FIG. 9 is a fragmentary perspective view of yet another alternative embodiment of the present invention;

DETAILED DESCRIPTION OF THE DISCLOSED EMBODIMENTS

Figure 1:
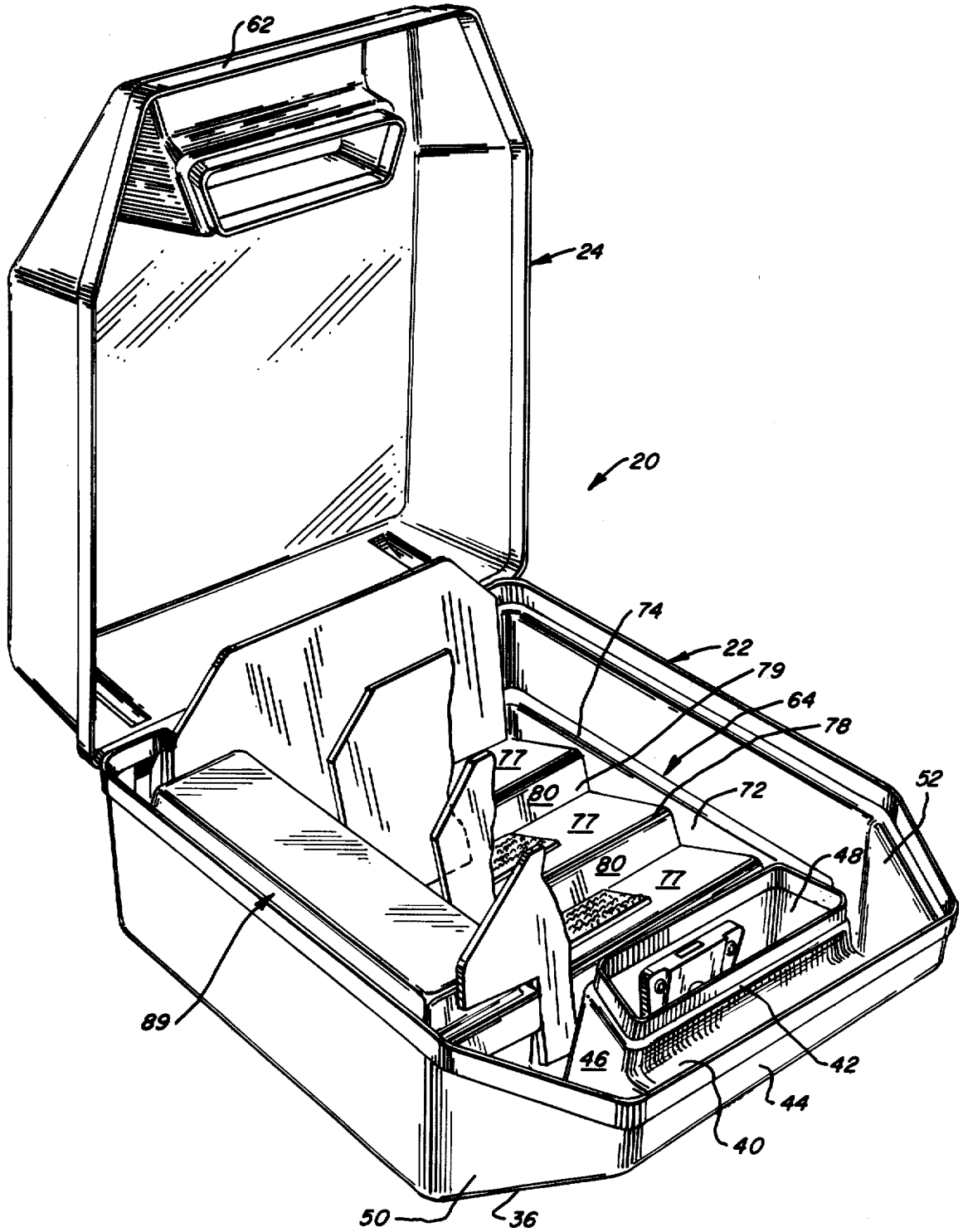
FIG. 1 is a perspective view partially broken away to show interior detail, of one embodiment of the present invention.

While this invention is susceptible of embodiment in many different forms, there is shown in the drawings and will herein be described in detail a preferred embodiment of the invention and modifications thereof, with the understanding that the present disclosure is to be considered as an exemplification of the principles of the invention and is not intended to limit the invention to the embodiments illustrated. The scope of the invention will be pointed out in the appended claims.

Referring to FIGS. 1–5, there is shown one embodiment of a document storage case 20 incorporating the present invention. The document storage case 20 includes a lower portion or document retaining housing 22 and an upper portion or cover 24 both of which are generaly similar in configuration, and which may conveniently be molded from a suitable plastic material.

The document housing 22 includes a bottom wall 26 and sidewalls 28, 30, 32 and 34. Sidewall 32 may be described as a back wall and extends between and is formed integrally with the sidewalls 28, 30. Sidewall 34 may be considered a front wall and extends partially between the sidewalls 28, 30. A sloping portion 36 extends forwardly and upwardly from the front edge of the bottom wall 26 on either side of the front wall 34 and terminates in a cross member or handle 40. Sidewall portions 42, 44 extend up from either side of the handle 40, and sidewall portions 46, 48 extend up from the periphery of the sloping portion 36. A pair of tapered sidewall extensions 50, 52 complete the housing.

The back wall 32 is configured with a generally planar center section 32a inwardly offset from a pair of laterally spaced back wall sections 32b located on either side of the center section 32a. A pair of feet or support members 54 on which the case may rest in an upright position are formed in the back wall sections 32b. A pair of hinge members 56 may be affixed to the center back wall section 32a through apertures 58 by suitable means, such as rivets (not shown).

An upstanding outwardly offset peripheral flange 60 extends substantially around the outer peripheral edges of the sidewalls forming the housing 22 (except for the center back wall section 32a), and provides additional strength to the sidewall as well as being adapted to be received within the cover 24 to provide a generally dust free enclosure.

The cover 24 is similar in configuration to the housing 22 and a detailed description would only be repetitive. The cover 24 includes a depending outwardly offset skirt 62 extending substantially around the peripheral edges of the cover 24. The skirt 62 is adapted to slidably pass over the housing flange 60 when the case 20 is closed, to provide the generally dust free enclosure for protecting documents contained within the case 20.

A tray-like insert 64 is adapted to be received within the housing 22 and is disposed between and in contact with the sidewalls 28, 30, 32, 34. The tray insert 64 itself includes sidewalls 66, 68, 70, 72 of which sidewall 66 may be considered a front wall and sidewall 68 may be considered a back wall. An outwardly extending lateral flange or ledge portion 74 extends outwardly from the upper peripheral edges of the sidewalls 66–72 of the insert 64.

The bottom of the insert tray 64 is formed as a plurality of inclined ramps 77. The apex 78 of each ramp 77 is connected to the low point 79 of the adjacent ramp 77 by a rearwardly inclined riser 80. All of the above components are formed as an integral part of the insert tray 64.

A plurality of substantially rigid document supports 81, 82, 83, 84 are suitably affixed, such as by adhesive, to each of the risers 80 except for the rearmost document support 84 which is affixed to the back wall 68 of the insert tray 64. At least the lower portion of each of the ramps 77 may be configured to inhibit sliding and pinching of the documents supported thereon. One suitable technique is to roughen the surface such as by attaching thereto a strip of material 86 such as the product sold under the brand name VELCRO.

Each of the ramps 77 is designed to support a group 88 of one of more documents resting thereon and against one of the document supports 81, 82, 83, 84. The configuration of the ramps 77 results in each document, if of uniform size, being slightly higher than the one behind it. This arrangement facilitates selection of individual documents by permitting manual engagement with the forwardmost document and tilting or flipping the document forward to expose the one next behind. At the same time, the surface configuration of the ramps 77 and the rearward slant of the backing members 81–84 inhibit bunching and pinching of the documents while they are flipped.

Figure 5:
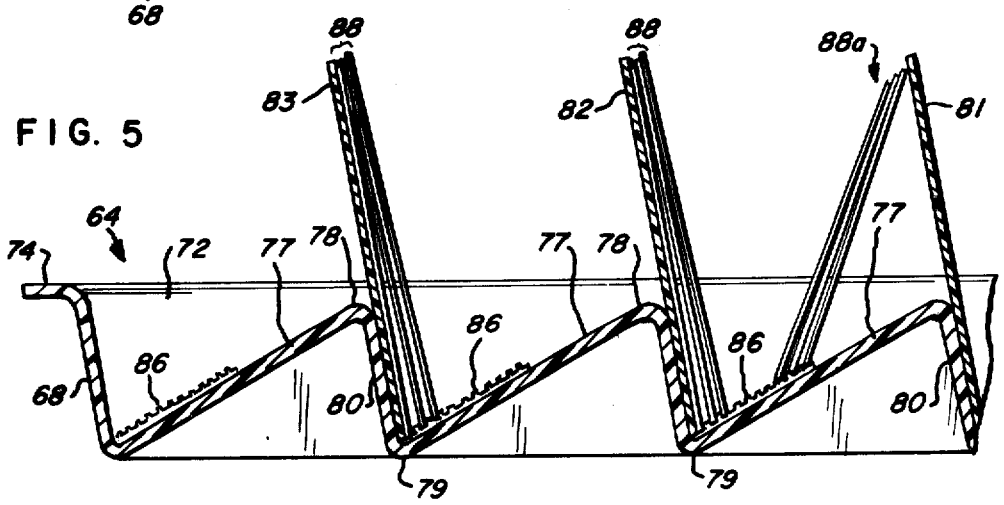
FIG. 5 is a fragmentary sectional view of the insert of FIG. 2 with document supports and documents in place.

As a result, as seen in FIG. 5, the flipped or forwardly tilted portion 88a of a group of documents is relatively stable and the documents 88a remain in the forward position to permit easy removal and replacement of a selected document without the forwardly displaced documents 88a inadvertently returning to their more stable position for any number of reasons typically the bunching and pinching that usually occurs.

Along these lines, it has been found that these results can be obtained when the ramps are constructed at an angle of about 15° and 35° relative to the plane of the bottom wall 26 of the housing 22 and that the risers typically have a slope of at least about 70° relative to that plane. In the embodiments shown in FIGS. 1–5, the ramps are formed at an angle of about 30° and the risers at an angle of about 80°.

In addition to the fact that the position of the forwardly displaced documents is a relatively stable one, the location of a selected document or of a position from which a document is removed, may be indicated by reorienting the next document in line by placing one corner thereof on the surface of the insert ledges 74 which act as a shelf.

Figure 3:
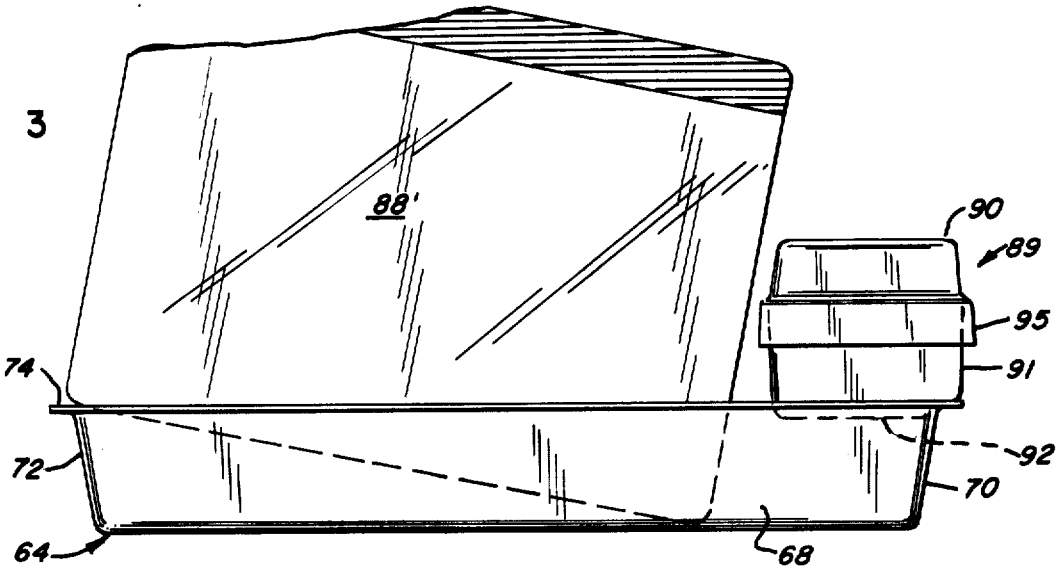
FIG. 3 is a rear elevation of the insert of FIG. 2 with a document of a first size having one edge resting on the shelf of the insert.
Figure 4:
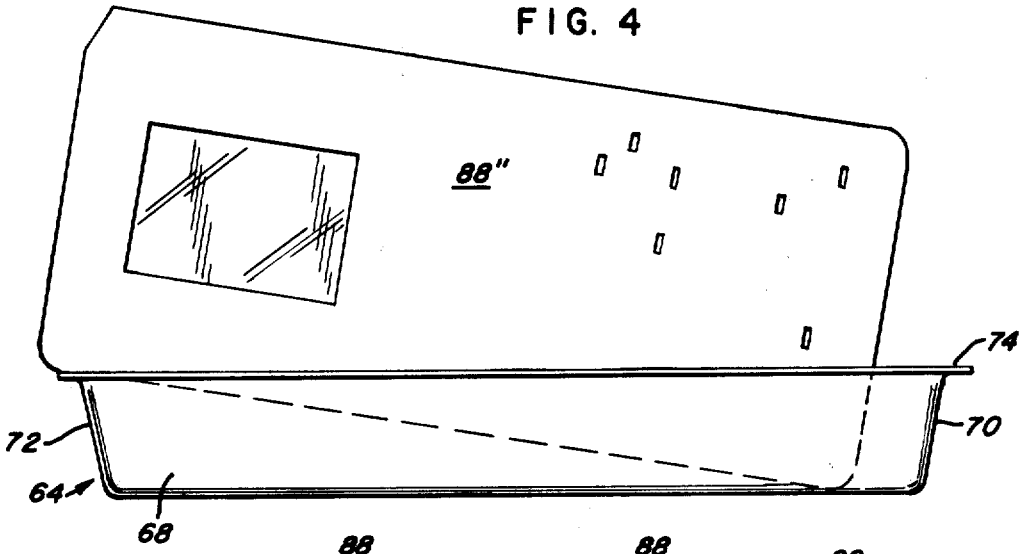
FIG. 4 is a rear elevation of the insert of FIG. 2 with a document of a second size having one edge resting on the shelf of the insert.

Thus, if more than one document is desired, or if inadvertently the forwardly displaced documents return to their rearward more stable position, the selected location is easily observed as shown in FIGS. 3 and 4.

In the embodiment of FIGS. 1–5, the insert 64 is designed to accommodate documents of differing widths. For example, the document 88' shown in FIG. 3 might be a microfiche while the document 88" shown in FIG. 4 is sized proportional to an aperture card. As seen, the microfiche 88' are narrower and higher than the aperture cards 88". When used to store microfiche, a spacer box 89 may be placed in the housing along one side thereof.

Figure 2:
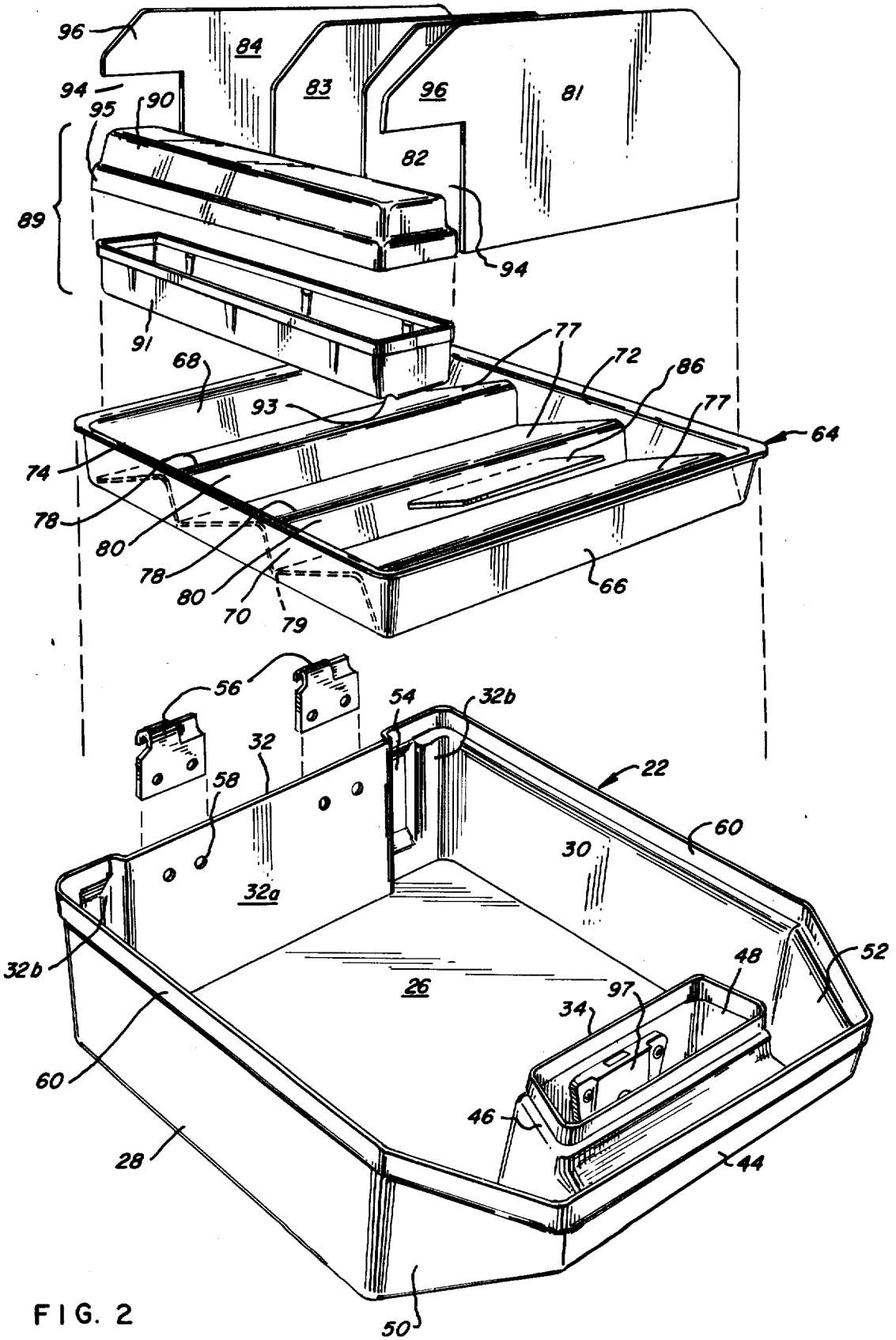
FIG. 2 is an exploded view of the embodiment of FIG. 1.

The spacer box 89 includes a lid 90 and a tray 91. One edge of the bottom 92 of the tray 91 is notched (at 93) to allow the box 89 to rest on the apexes 78 of the ramps 77 with the notch 93 disposed along the corner of the ledge 74, all as seen in FIGS. 2 and 3. The front and rear document supports 81, 84, are wider than the two intermediate document supports 82, 83, and having a portion 94 cut out therefrom in which the ends of the spacer box may be inserted with the peripheral flange 95 of the top 90 retained in place by the extension 96 of the document supports. Although relatively rigid, the document supports are sufficiently flexible to permit removal of the spacer box 89.

It can readily be observed, that the embodiment of FIGS. 1–5 is portable and when the cover 24 is placed onto the housing 22 and closed the case 20 may be readily carried. If desired, a suitable latch 97 may be affixed to the outer surface of the wall 42 as shown in FIGS. 1 and 2.

Figures 6, 6A:
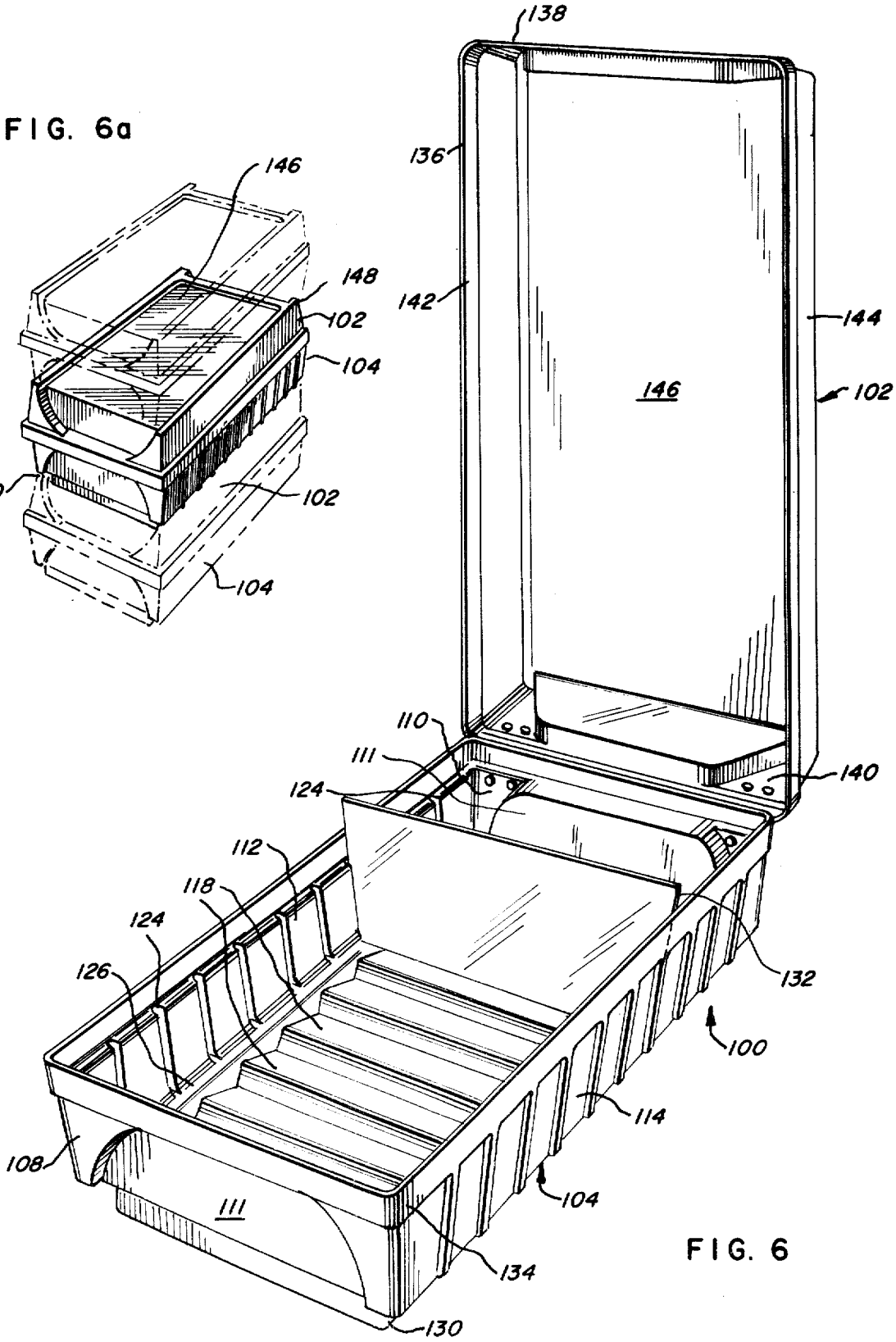
FIG. 6 is a perspective view of a first alternative embodiment of the present invention.
FIG. 6a is a perspective view of the embodiment of FIG. 6 with the top closed.

Cases incorporating the present invention may also be designed for desk top use and permanent storage. One such embodiment is shown in FIGS. 6–8 wherein the case 100 includes a cover 102 and a housing 104. The housing 104 includes sidewalls 108, 110, 112 and 114, and a bottom wall 116. For convenience, the sidewall 108 may be considered a front wall and the sidewall 110 may be considered a backwall. The front wall 108 and the backwall 110 may include a central recessed portion 111 which acts as a handle or gripping portion.

The bottom wall 116 is formed as a plurality of inclined ramps 118 with the apex 120 of each ramp connected to the lowermost portion 121 of the next adjacent ramp by a rearwardly slanted riser 122. In the embodiment of FIGS. 6–8, the ramps 118 and risers 122 are formed integrally as a part of the bottom wall 116 and, therefore, the housing 104.

As best seen in FIG. 8, each of the ramps 118 is inclined at an angle of about 30° relative to a plane parallel to the bottom portions 121 of the ramps 118, although the housing may be constructed with the ramps formed at an angle of between about 15° and about 35°. The risers 122 have a slope of at least 70° relative to the plane defined above and in the construction shown in FIGS. 6–8 the risers are disposed at an angle of about 80° relative thereto.

The surfaces of each of the inclined ramps 118 may, as described above, be roughened or otherwise configured to inhibit movement of the documents and resulting pinching together. However, since the ramps 118 are shorter than the ramps disclosed in the embodiment of FIGS. 1–5, the problem of pinching is not as significant.

The sidewalls 112, 114 of the housing 104 are formed with a plurality of generally vertical slots 124 which extend up from a ledge 126 disposed between the sidewalls 112, 114 and the ramps 118. Inner sidewalls 128 depend from the inner edge of the ledges 126 to intersect the ramps 118 and the risers 122. The ledges 126 and inner sidewalls 128 define a pair of external notches 130 to facilitate stacking of the cases 100 on each other as shown in FIG. 6a. One or more generally rigid planar document supports 132 are adapted to be slidably received within opposed slots in the sidewalls 112 and 114 to support groups of documents resting on the inclined ramps 118.

The walls 110, 112, 114, 116 of the housing 104 terminate at their upper free ends in an outwardly offset upwardly extending flange 134 which provides additional strength to the walls and also is adapted to be slidably received within a corresponding skirt portion 136 formed at the terminal edges of the sidewalls 138, 140, 142, 144 of the cover 102. As seen in FIG. 6a, the top 146 of the cover 102 is provided with a peripheral raised bead 148 extending around the free edges thereof. The notch 130 in the housing 104 is adapted to fit over the bead 148 with the inner sidewalls 128 slidably received along the inner edges of the head 148 to facilitate stacking of cases 100 as shown in FIG. 6a. The omission of a raised bead along one end of the top 146 facilitates the slidable movement of one case onto the other.

In the embodiment shown in FIGS. 6–8, the spacing between the inner sidewalls 128 is sufficient to accommodate documents of a first size, e.g., microfiche. If the cases are to be utilized for storing aperture cards, the spacing between the sidewalls 112, 114 is selected to accommodate such documents which then rest directly on the ledges 126. In this embodiment, the microfiche which normally rest on the ramps 118 may be reoriented by placing a corner of one document on the ledge 126 for indicating a desired location or the position from which a document had been removed.

Figure 10:
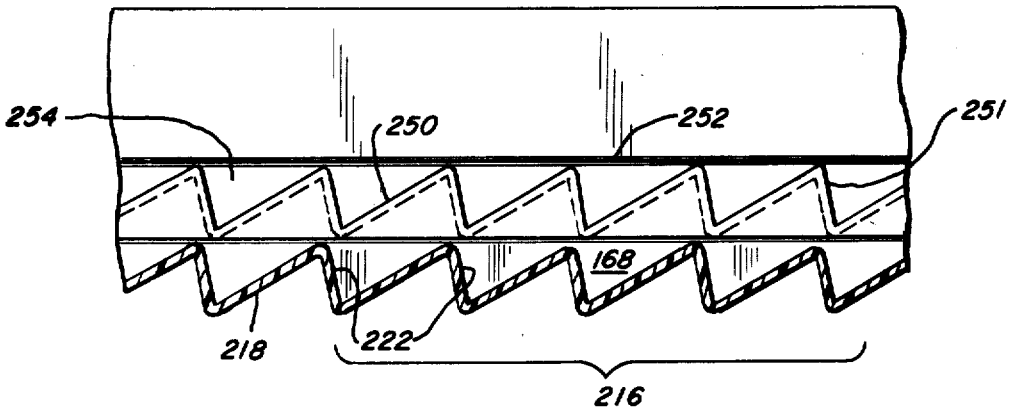
FIG. 10 is a fragmentary elevation, partly in section, of the embodiment of FIG. 9.

If the embodiment of FIGS. 6–8 is used to store documents wider than the spacing between the inner walls, e.g., aperture cards, the advantages of the present invention attributed to the inclined ramps are not fully realized. The embodiment of FIGS. 9 and 10 overcomes this deficiency.

In this embodiment, as in the embodiment of FIGS. 6–8, the ramps 218 and risers 222 are integrally formed as part of the bottom wall 216, and still intersect the inner sidewall 228 which depend from the inner edge of the ledge 226. In this embodiment, however, the ledges 226 are wider than the ledges 126 and the outer portion of each ledge 226 is formed with inclined ledge ramps 250 and risers 251 disposed in vertical alignment with the ramps 218 and risers 222. An additional upper ledge 252 is disposed between the ramps 250 and the sidewalls 212 and 214 with an intermediate sidewall 254 depending from upper ledge 252 and intersecting ramps 250 and risers 251. Thus, the embodiment of FIGS. 9 and 10 incorporates the advantages of the present invention for documents of different sizes and provides desired flexibility in use of the case. Although not shown in FIGS. 9 and 10, it is clear that slots may be formed in the sidewalls 212, 214 to accommodate and slidably receive document supports the function of which is as described above. In this embodiment, documents of different sizes may be arranged in sequential groups so that the case may accommodate simultaneously or alternatively documents of different sizes.

Figure 11:
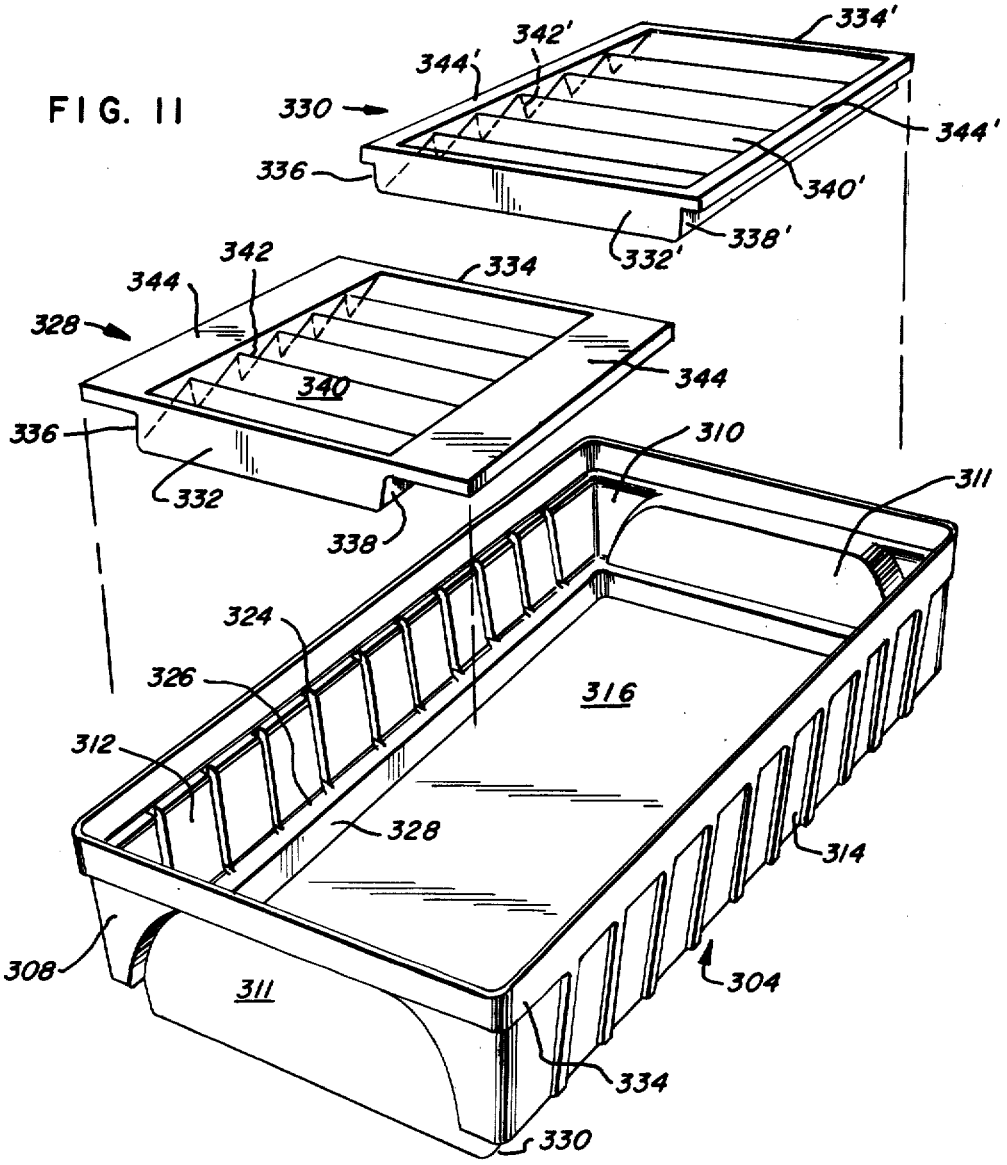
FIG. 11 is an exploded perspective view of another alternative embodiment of the present invention.
Figure 12:
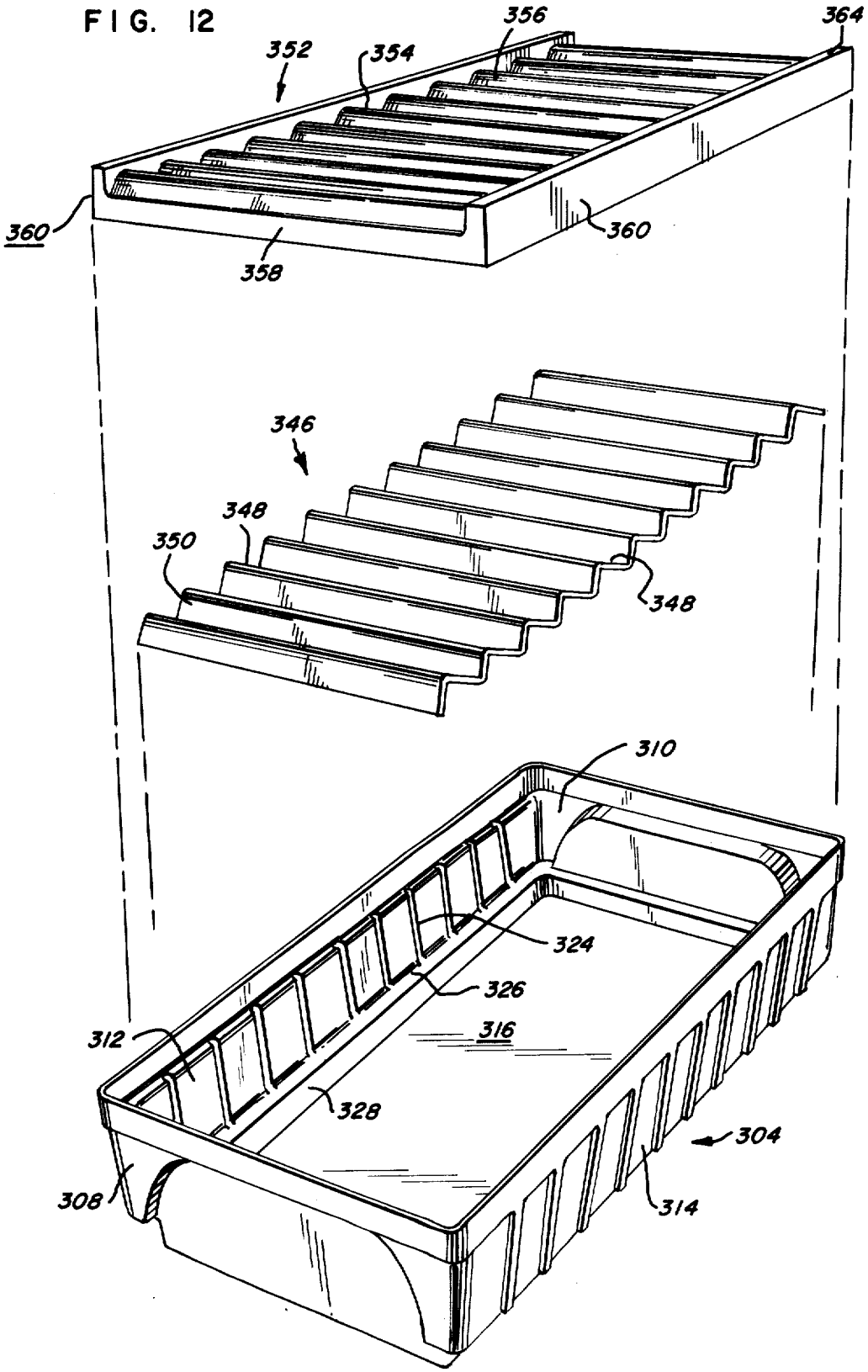
FIG. 12 is an exploded perspective view of a variation of the embodiment of FIG. 11.

Further flexibility of the case incorporating the present invention may be achieved by forming the housing 304 as shown in FIGS. 11 and 12. In this embodiment, with the exception of the change in the bottom wall 316, which is generally planar, the construction is generally similar to the housing shown in FIG. 6.

Thus, in the embodiment shown in FIGS. 11 and 12, the housing 304 includes sidewalls 308, 310, 312 and 314, and a generally planar bottom wall 316. The sidewall 308, the front wall, and the sidewall 310, the back wall both include a central recessed portion 311 which provides a handle or gripping portion.

The sidewalls 312, 314 of the housing 304 are formed with a plurality of generally vertical slots 324 which extend up from a ledge 326 disposed between the sidewalls 312, 314 and inner sidewalls 328 which depend from the inner edges of the ledges 326 to intersect the bottom wall 316. The upper peripheral edges of the sidewalls 308, 310, 312, 314 terminate in an outwardly offset upwardly extending flange 334 which accommodates a cover such as the cover 102 shown in the embodiment of FIGS. 6 and 6*a*.

The area within the inner sidewalls 328 defines in conjunction with the bottom wall 316 a recess adapted to receive a variety of possible inserts. Two such inserts 328, 330 are shown in FIG. 11. The insert 328 is formed with front and backwalls 332, 334, respectively, and a pair of sidewalls 336, 338. A plurality of inclined ramps 340 are disposed within the walls 332, 334, 336, 338 the ramps 340 being interconnected by a plurality of risers 342. A pair of laterally extending flanges or ledges 344 extend outwardly from the sidewalls 336, 338. The overall lateral dimension between the peripheral edges of the flanges or ledges 344 and the depth of the walls 332–338 permit the insert 328 to fit within the central recess of the housing 304 with the edges of the ledges 344 abutting the inner sidewalls 328 of the housing 304.

The insert 330 is quite similar to the insert 328 in that it includes front wall 332', a back wall 334', sidewalls 336', 338', inclined ramps 340' interconnected by risers 342' and a pair of laterally extending ledges 344' extending outwardly from the sidewalls 336', 338'. The overall lateral dimension of the insert 330 is the same as that of the insert 328, but the distance between the sidewalls 336' and 338' is greater than the distance between the sidewalls 336 and 338. Therefore, the insert 330 is adapted to accommodate documents of greater width on the ramps 340' that can be accommodated on the ramps 340 of the insert 328.

As seen in FIG. 11, the inserts are adapted to be simultaneously inserted into the housing 304 to rest within the recess one behind the other. In this way, the housing 304 is capable of storing two different size documents simultaneously. In the embodiment shown in FIG. 12, the housing 304 is identical to that shown in FIG. 11. The flexibility of such a housing is illustrated by the inserts shown in FIG. 12.

A first of these inserts 346 is formed simply with inclined ramps 348 and interconnected risers 350. The insert 346 is adapted to fit within the central recess and rests on the bottom wall 316 with the apexes of each ramp lying in a plane no higher than the plane of the ledges 326.

If the housing is to be used for storing wider documents, an additional or alternative insert 352 may be utilized. The insert 352 includes in addition to the ramps 354 and risers 356, a front wall 358, a back wall (not shown) and two sidewalls 360. A pair of ledges extend between the sidewalls 360 and the ramps 354. The insert 352 is adapted to fit within the sidewalls 312, 314 of the housing 304 and rests on the ledges 326. The ledges 364 of the insert 352 are narrower than the ledges 326 and the ramps 354 are wider than the ramps 348 of insert 346. Thus, one housing shown both in FIGS. 11 and 12 may be adapted by the selection of various inserts for simultaneous or alternative storage of various document sizes.

Figure 13:
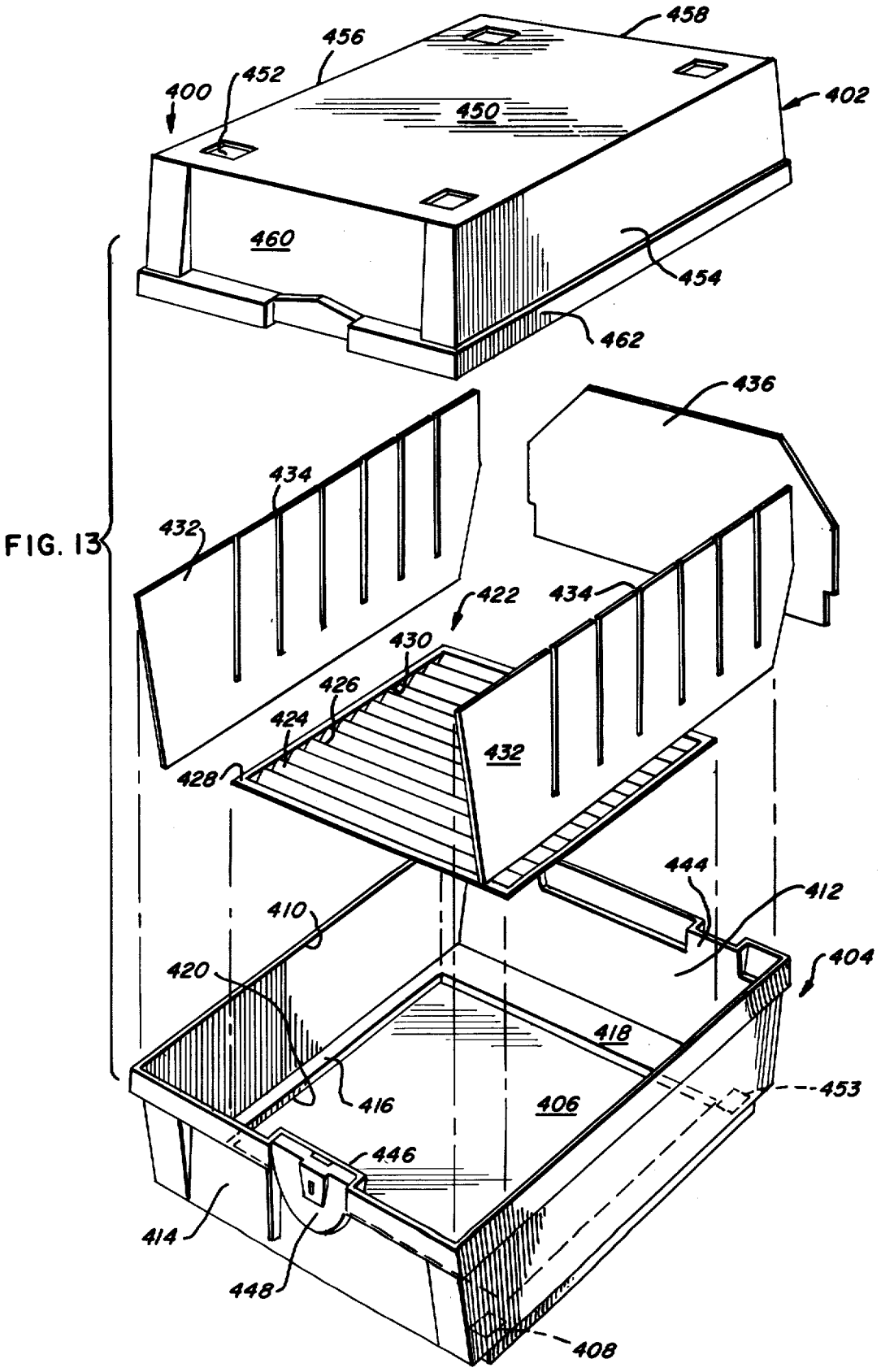
FIG. 13 is an exploded view of an additional alternative embodiment of the present invention.
Figure 14:
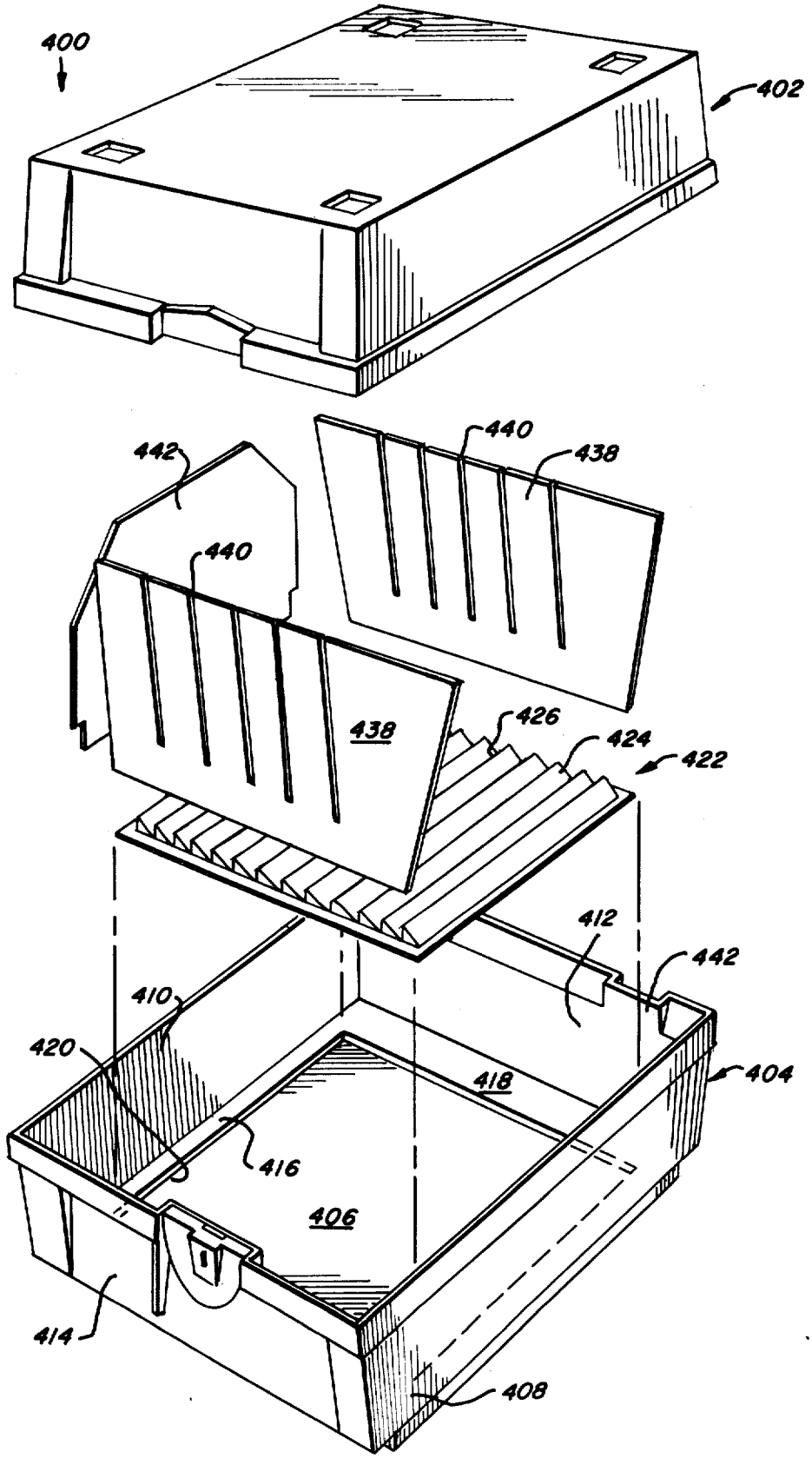
FIG. 14 is an exploded view of the embodiment of FIG. 13 with some of the parts rearranged.

FIGS. 13 and 14 show an additional alternative embodiment of a generally portable and transportable case 400 incorporating the present invention. In this embodiment, the case 400 includes a top or cover 402 and a housing 404, both of which are generally similar in configuration.

The housing 404 includes a bottom wall 406 in which are formed a plurality of feet or support members 407. Four slightly tapered sidewalls 408, 410, 412, 414, extend up from the bottom wall 406. As shown, the housing 404 is generally rectangular in shape with two of the sidewalls 408, 410 being longer than the other two sidewalls 412, 414. The inner surface of the bottom wall 406 includes two pairs of opposed ledges 416, 418 which define therewithin a centrally disposed generally square recess 420. Since the central recess 420 is square, the ledges 418 adjacent the shorter sidewalls 412, 414 are wider than the ledges 416 adjacent the longer sidewalls 408, 410.

A generally square double purpose insert 422 is adapted to fit in the recess 420. The insert 422 defines a plurality of inclined ramps 424 and interconnecting risers 426. A ledge 428 extends along the peripheral edges of the insert 422 in a plane substantially co-planar with the apexes 429 of the ramps 424 as shown in FIG. 13. Thus, when the insert 422 is placed into the housing as shown in FIG. 13, the ledge 428 abuts the ledges 416, 418 and is co-planar therewith. The width of the ramps 424 between the insert sidewalls 430 depending from the ledges 428 is sufficient to accommodate documents of a first size, e.g., microfiche.

A pair of sidewall inserts 432 are slidably received along the longer sidewalls 408, 410. The sidewall inserts 432 are formed with a plurality of slots 434 positioned to be adjacent the risers 426 of the insert 422 and adapted to slidably receive a document support 436, in a manner described above.

When it is desired to utilize the case 400 for larger documents, the insert 422 is turned over and rotated 90° as shown in FIG. 14. The ledge 426 now lies on the bottom wall 406 within the recess 420. A second pair of sidewall inserts 438 are slidably received along the shorter two sidewalls 412, 414. The sidewall inserts 438 include slots 440 for slidably receiving a document support 442. Since the insert ledges 426 are in contact with the bottom wall 406, the case 400 may be utilized to accommodate wider documents which when resting on the ramps extend over the housing ledges 418.

As shown in FIGS. 13 and 14, one of the shorter sidewalls 412 may be considered a back wall and is notched at 442 to receive a pair of hinge members (not shown) suitably affixed thereto. The other shorter sidewall 414 may be considered the front wall and is centrally notched at 446 to receive a latch mechanism 448 suitably affixed thereto.

As indicated above, and as seen in FIGS. 13 and 14, the cover 402 is of the same general configuration as the housing 404 and thus includes a generally planar top wall 450 in which are formed a plurality of detents 452 adapted to receive the feet or support members 453 of another case to facilitate stacking. The cover 402 also includes four sidewalls 454, 456, 458, 460 with the shorter walls being notched to receive the matching portions of the hinge members and latch mechanism 448. The peripheral edges of the sidewalls terminate in an outwardly offset skirt portion 462 which is adapted to fit over the sidewalls of the housing 404 to provide a dust-tight enclosure for the stored documents.

Figure 15:
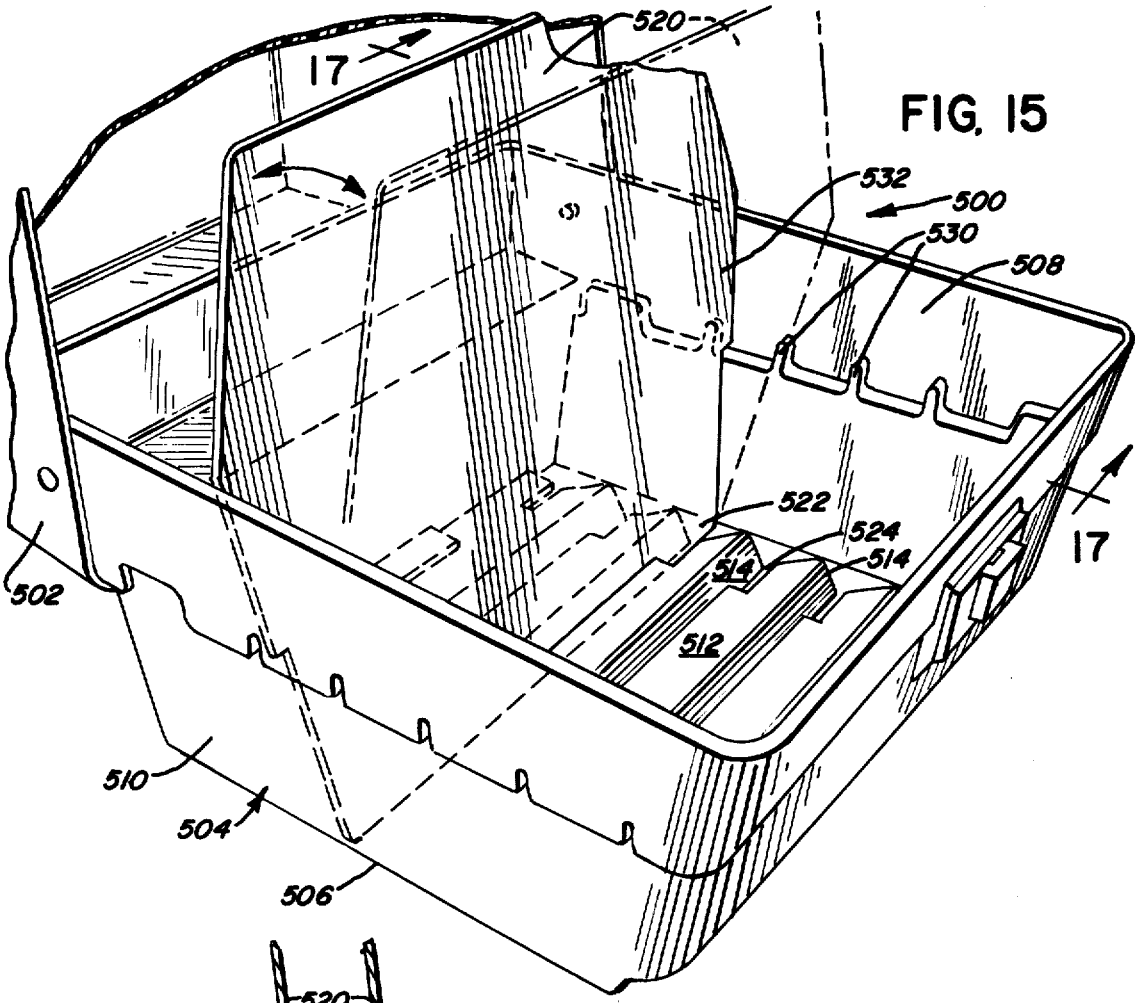
FIG. 15 is a fragmentary perspective view, partly in phantom, of another alternative embodiment of the present invention.
Figure 16:
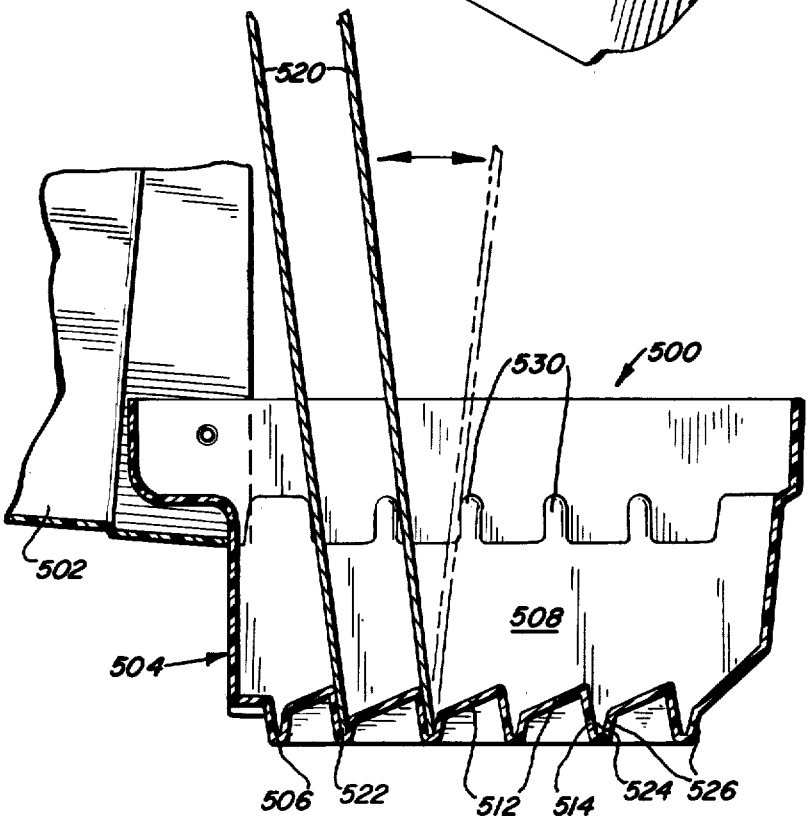
FIG. 16 is a fragmentary elevation, partly in phantom and partly in section, of the embodiment of FIG. 15.

Additional advantages are realized when the document supports can be retained in a rearwardly leaning stable position, while also being movable to a forward position, as shown by case 500 in FIGS. 15 and 16.

Case 500 includes a top or cover 502 and a housing 504, both of which can be generally similar in configuration. The housing 504 includes a bottom wall 506 and a pair of sidewalls 508 and 510. A plurality of inclined ramps 512 are also provided and, as shown in FIG. 16, can be integral with and define the bottom wall 506 of the housing. Risers 514 interconnect the lowest point of one ramp 512 with the highest point of an immediately adjacent ramp.

Document supports 520 are received in the housing, as described below, for support documents (not shown). Each document support 520 is a generally planar substantially rigid member which is positioned adjacent to a selected one of the risers 514 with the bottom edge of the document support resting on the lower portion of the ramp 512 immediately adjacent to the riser 514. The document supports 520 include downwardly projecting portions or flanges 522.

In the embodiment shown in FIGS. 15 and 16, each of the ramps 512 defines a pair of recesses 524 for receiving the projecting portions 522 of a document support 520 to retain the document support in a rearwardly leaning stable position (shown in solid lines in FIGS. 15 and 16). Each recess is positioned generally at the junction of one of the risers 514 and the lowest point of an immediately adjacent ramp 512.

A first abutment 526 (FIG. 16) having a height no greater than the height of ramps 512 defines a front end of each of the recesses 524. The lowermost point of the front end of each recess, i.e., the base of abutment 526, is spaced from the lowest point of the corresponding riser 514 by a distance at least as great as the thickness of the projecting portions 522 of the document support 520. Thus, each projecting portion 522 fits within the space of a recess 524 between riser 514 and the front end 526 of the recess 524. In the rearwardly leaning stable position, the document support 520 has one face which abuts a riser 514, and an opposite face of the projecting portions 522 which abut the front ends of a pair of recesses 524, thereby retaining the document support in position and preventing the document support from sliding along the ramp 512.

Each of the recesses 524 extends across only a portion of the width of the ramps 512 so that documents will not fall into the recesses. As shown, the recesses 522 can be located at both sides of the housing 504, although visible along only sidewall 508 in FIG. 16. In this embodiment, the back end of each recess is defined by a riser 514, the bottom of each recess is defined by the bottom wall 506 of the housing 504, and the front end or abutment 526 of each recess is defined by a wall portion extending from the bottom wall 506 to an intermediate portion of a ramp 512.

The document support 520 can be tilted from the rearwardly leaning stable position shown in solid lines in FIGS. 15 and 16, to a forward leaning position shown in phantom. It is desirable to have the document support retained in the forward position as well as the rearward position. To accomplish this result, second abutments 530 formed in the sidewalls 508, 510 are provided which cooperate with and are engageable with the document support 520 to retain it in the forwardly leaning position. The document support 520 is thereby tiltable between backwardly and forwardly leaning positions and is retained in both of the positions.

The second abutments 530 are a plurality of inwardly extending projections 530 on sidewalls 508 and 510. Each of the document supports 520 is further provided with corresponding outwardly projecting side extensions 532 (FIG. 15) which are engageable with the projections 530 when the document support is in the forwardly leaning position. The document support is retained in the forwardly leaning position because one face of the document support abuts a projection 530, and the opposite face of the document support abuts a riser 514. The foregoing elements cooperate to retain the document support in a forwardly leaning stable position and prevent the document support from sliding along a ramp.

The projections 530 preferably are positioned so that the document support engages one of the projections when in the forward position, and engages an immediately adjacent projection when in the rearward position to further retain the document support in the rearward position.

The forwardly leaning and rearwardly leaning positions are on opposite sides of a vertical position, and the document support must be moved overcenter from one position to the other.

Figure 17:
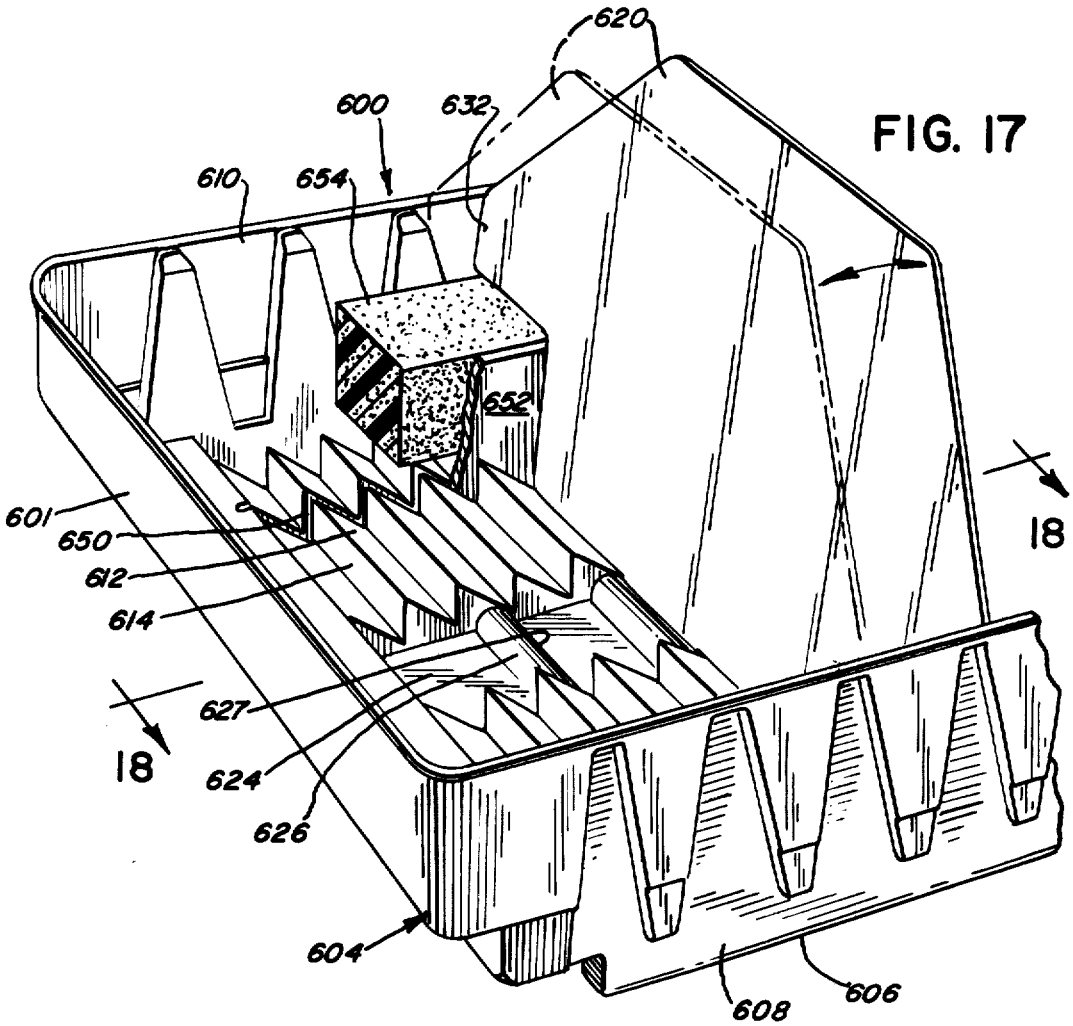
FIG. 17 is a fragmentary perspective view, partly in phantom, of another alternative embodiment of the present invention.
Figure 18:
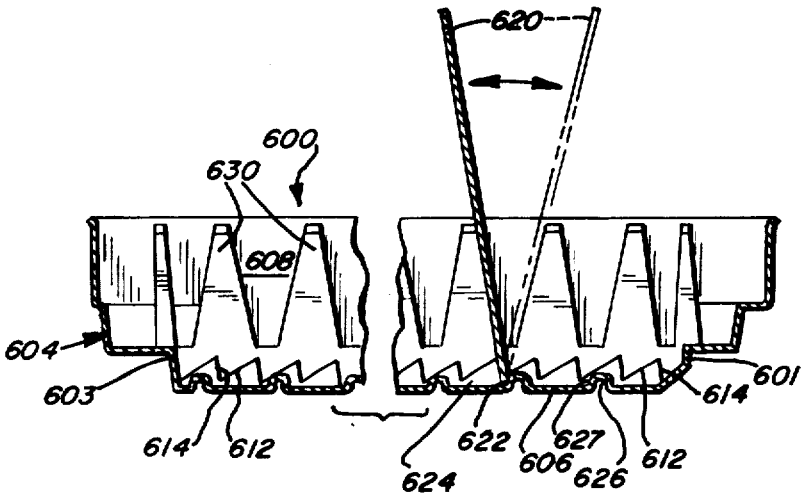
FIG. 18 is a fragmentary elevation, partly in phantom and partly in section, of the embodiment of FIG. 17.

Case 600 illustrated in FIGS. 17 and 18 is similar to case 500 shown in FIGS. 15 and 16. The same last two digits in each numeral in the five hundred series and the six hundred series are used to refer to like elements in the two embodiments.

Inclined ramps 612 are connected by risers 614. Document supports 620 are generally planar substantially rigid members which are received in the housing 604 and have a bottom edge which rests on the lower portion of a ramp 612 adjacent to a riser 614. The document supports have a downwardly projecting portion or flange 622 (FIG. 18).

Recess 624 is substantially continuous from the front wall 601 to the back wall 603 of the housing 604, and has a bottom defined by the bottom wall 606 of the housing. The substantially continuous recess 624 is interrupted by spaced apart first abutments 626 which are integral with the bottom wall 606 of the housing 604 and project upwardly therefrom. The abutments 626 do not extend above the surface of the ramps 612, and, therefore, do not interfere with documents resting on the ramps.

Each abutment 626 has a front surface 627 which, at its base, is spaced from the base of a riser 614 by a distance at least as great as the thickness of the projecting portion 622 of the document support 620. The distance preferably is less than twice the thickness of projecting portion 622. In the rearwardly leaning stable position, the document support 620 has one face which abuts rise 614, and an opposite face which abuts front surface 627 of abutment 626.

In this embodiment, only one recess is provided across the width of the housing, and each recess is generally centrally positioned across the width of the housing. Also, only one abutment 626 is provided for every two ramps 612, as shown in FIGS. 17 and 18.

Projections 630 are provided on sidewalls 608 and 610 to cooperate with extensions 632 (FIG. 17) on the document supports 620 to retain each document support in the forwardly leaning position. Projections 630 are at an angle to the vertical corresponding to the angle at which the document support is to be retained in either the forward or rearwardly leaning position.

According to a further feature of this embodiment, case 600 is adapted to store documents of two different sizes. The distance between sidewalls 608 and 610 is sufficient to accommodate documents of a larger size on the ramps 612. The ramps 612 each have a discontinuity or slot 650 extending from the lowest point of each ramp to the highest point, parallel to the sidewalls 608 and 610, as depicted in FIG. 17. A generally planar and substantially rigid insert 652 has a thickness less than the width of the slots 650 and is removably received in the slots. Documents of a smaller size are accommodated in the housing between one of the sidewalls and the insert 652. The area between the other sidewall and the insert 652 can be used for storage, or can be filled with a strip 654 of foam rubber or other suitable material. The insert 652 has the further advantage of providing additional support and rigidity to the housing and to reduce any tendency for the sidewalls of the housing to bend outwardly.

Thus, there has been disclosed a document storage and access case in which each of a plurality of groups of documents rest on one of a plurality of inclined ramps to facilitate access to individual documents and to maintain documents in two stable positions to facilitate replacement of a document removed. In addition, the case incorporating the present invention may incorporate ledges along the edges of the ramps on which a corner of a document may be rested to alter the orientation of that document relative to the remainder of the documents and to identify a selected position or a position from which a document has been removed.

The document storage and access cases incorporating the present invention are flexible, accommodate simultaneously and/or alternatively groups of documents of different sizes, and may be constructed to be transportable for desk use and/or for permanent storage.

From the foregoing, it will be observed that numerous variations and modifications may be effected without departing from the true spirit and scope of the novel concept of the invention. It is, of course, intended to cover by the appended claims all such modifications as fall within the scope of the claims.

What is claimed is:

1. A document storage and access case for a plurality of groups of documents comprising:

a housing having bottom wall means, sidewall means an an open top;

a plurality of inclined ramp means extending forwardly up from said bottom wall means at a shallow angle relative thereto, each of said ramp means being adapted to support a group of documents thereon;

document support means cooperating with at least one of said ramp means for supporting groups of rearwardly leaning documents resting on said ramp means, the angle of said ramp means permitting each document of a group to be supported with one edge resting thereon in a position so that when the documents within each group are of uniform height dimension the top edge of selected document in the group is higher than the documents disposed rearwardly thereof permitting each said selected document to be individually gripped and tilted to a stable forwardly leaning position to provide access to the remaining documents of the group; means for supporting said selected documents in said stable forwardly leaning position.

2. A document storage and access case as defined in claim 1 including:

laterally outwardly extending ledge means disposed between said ramp means and said sidewall means to accommodate thereon a portion of a document;

whereby a document having a portion positioned on said ledge means is oriented differently from the documents resting on said inclined ramps to indicate the position of that document within a group of documents.

3. A document storage and access case as defined in claim 2 including:

inner sidewall means depending from the inner peripheral edge of said ledge means, said inner sidewall means being spaced apart a distance at least as great as the length of documents supported on said ramp means; and wherein said plurality of ramp means extend between said inner sidewall means.

4. A document storage and access case as defined in claim 3 wherein:

said inner sidewall means taper inwardly and downwardly to facilitate positioning a portion of a document on said ledge means.

5. A document storage and access case as defined in claim 3 wherein:

said ledge means comprises first ledge means; and including:

second laterally extending ledge means disposed between said first ledge means and said sidewall means; and intermediate sidewall means depending from the inner peripheral edge of said second ledge means;

the outer peripheral edge of said first ledge means intersecting said intermediate sidewall means.

6. A document storage and access case as defined in claim 5 wherein:

said first and second ledge means are co-planar.

7. A document storage and access case as defined in claim 5 wherein:

said first ledge means is closer to said bottom wall than said second ledge means.

8. A document storage and access case as defined in claim 7 wherein:

said inclined ramp means comprises first inclined ramp means; and said first ledge means includes a plurality of second inclined ramp means lying in planes generally parallel to said first inclined ramp means, whereby groups of documents of a first size are disposed between said inner sidewall means and are supported on each of said first inclined ramp means and groups of documents of a second size are disposed between said intermediate sidewall means and are supported on each of said second inclined ramp means.

9. A document storage and access case as defined in claim 3 wherein:

said inclined ramps, said ledge means and said inner sidewall means form part of an insert disposed within said housing.

10. A document storage and access case as defined in claim 9 wherein:

the highest point of said inclined ramp means is no higher than said ledge means.

11. A document storage and access case as defined in claim 9 wherein:

the insert sidewall means taper inwardly and downwardly to facilitate positioning a portion of a document on said ledge means.

12. A document storage and access case as defined in claim 9 wherein:

said insert includes riser means extending between the lowest and highest points of adjacent ones of said ramp means.

13. A document storage and access case as defined in claim 12 wherein:

each of said ramp means is inclined at an angle of between about 15° and about 35° relative to said bottom wall means; and each of said riser means is inclined at an angle of at least about 70° relative to said bottom wall means.

14. A document storage and access case as defined in claim 12 wherein:

each of said ramp means is inclined at an angle of about 30° relative to said bottom wall means; and each of said riser means is inclined at an angle of about 80° relative to said bottom wall means.

15. A document storage and access case as defined in claim 14 wherein:

at least a portion of the surface of each of said ramp means is configured to increase the coefficient of friction with the edges of the document supported thereon to inhibit movement of said documents relative to said ramp means.

16. A document storage and access case as defined in claim 15 including:

means having a roughened surface affixed to the surface of each of said ramp means for effecting said increased coefficient of friction with the edges of the document supported thereon.

17. A document storage and access case as defined in claim 12 wherein:

said document support means is generally planar substantially rigid member disposed adjacent selected ones of said riser means.

18. A document storage and access case as defined in claim 17 including:

means for retaining said document support means in position adjacent selected ones of said riser means.

19. A document storage and access case as defined in claim 18 wherein:

said retaining means includes a plurality of aligned slots formed in said sidewall means for slidably receiving said document support means.

20. A document storage and access case as claimed in claim 19 wherein:

said document support means retained in said aligned slots rests on said ledge means.

21. A document storage and access case as defined in claim 17 including:

a plurality of said document support means; and means securing each of said document support means to one of said riser means.

22. A case as defined in claim 9 including:

second laterally extending ledge means integrally formed as a part of said housing and disposed between said insert ledge means and said sidewall means; and intermediate sidewall means depending from the inner peripheral edge of said second ledge means;

said insert being disposed between said intermediate sidewall means with the outer peripheral edge of said insert ledge means being located adjacent intermediate sidewall means.

23. A document storage and access case as defined in claim 22 wherein:

said first and second ledge means are co-planar.

24. A document storage and access case as defined in claim 22 wherein:

said insert is a first insert; and including:

alternative insert means substitutable for said first insert and having:

an alternative plurality of inclined ramp means having a configuration substantially the same as said inclined ramp means of said first insert, alternative laterally extending ledge means, and the inner peripheral edge of said alternative ledge means, said alternative inner wall means being spaced apart a distance different than the distance between the inner sidewall means of said first insert, the outer peripheral edge of said alternative ledge means being located adjacent said intermediate sidewall means when said alternative insert is disposed between said intermediate sidewall means.

25. A document storage and access case as defined in claim 3 including:

a cover having top wall means, sidewall means and an open bottom adapted to fit on said housing for providing a generally dust free enclosure; and a raised portion extending around at least a substantial portion of the periphery of said top wall means for slidably receiving a housing thereon with the inner sidewall means of said housing retained within said raised portion.

26. A document storage and access case as defined in claim 2 including:

riser means extending between the lowest and highest points of adjacent ones of said ramp means.

27. A document storage and access case as defined in claim 26 wherein:
said document support means is a generally planar substantially rigid member disposed adjacent selected ones of said riser means.

28. A document storage and access case as defined in claim 27 including:
means for retaining said document support means in position adjacent selected ones of said riser means.

29. A document storage and access case as defined in claim 28 wherein:
said retaining means includes a plurality of aligned slots formed in said sidewall means for slidably receiving said document support means.

30. A document storage and access case as claimed in claim 29 wherein:
said document support means retained in said aligned slots rests on said ledge means.

31. A document storage and access case as defined in claim 27 including:
a plurality of said document support means; and
means securing each of said document support means to one of said riser means.

32. A document storage and access case as defined in claim 1 including:
riser means extending between the lowest and highest points of adjacent ones of said ramp means.

33. A document storage and access case as defined in claim 32 wherein:
each of said ramp means is inclined at an angle of between about 15° and about 35° relative to said bottom wall means.

34. A document storage and access case as defined in claim 33 wherein:
each of said riser means is inclined at an angle of at least about 70° relative to said bottom wall means.

35. A document storage and access case as defined in claim 33 wherein:
each of said ramp means is inclined at an angle of about 30° relative to said bottom wall means.

36. A document storage and access case as defined in claim 35 wherein:
each of said riser means is inclined at an angle of about 80° relative to said bottom wall means.

37. A document storage and access case as defined in claim 36 wherein:
said document support means is a generally planar substantially rigid member disposed adjacent selected ones of said riser means.

38. A document storage and access case as defined in claim 37 including:
means for retaining said document support means in position adjacent selected ones of said riser means.

39. A document storage and access case as defined in claim 38 wherein:
said retaining means includes a plurality of aligned slots formed in opposite sidewall means for slidably receiving said document support means.

40. A document storage and access case as claimed in claim 39 wherein:
said slots retain said document support means in a plane generally perpendicular to the plane of said bottom wall means.

41. A document storage and access case as defined in claim 37 including:
a plurality of said document support means; and
means securing each of said document support means to one of said riser means.

42. A document storage and access case as defined in claim 32 wherein:
the surface of each of said ramp means is configured to inhibit movement along said surface of the edges of the documents supported thereon.

43. A document storage and access case as claimed in claim 42 wherein:
only the lower portion of the surface of each of said ramp means is configured to inhibit movement of the supported edges of the documents.

44. A document storage and access case as defined in claim 43 including:
means having roughened surface affixed to the surface of each of said ramp means for increasing the coefficient of friction between said roughened surface and the edges of the document supported thereon whereby the documents are retained in place.

45. A document storage and access case as defined in claim 32, wherein:
said document support means comprises a generally planar substantially rigid member disposed adjacent a selected one of said riser means with the bottom edge of said document support means resting on the lower portion of a ramp means immediately adjacent to said riser means, said document support means including a downwardly projecting portion and having a generally stable rearwardly leaning position;
a recess for receiving said projecting portion at the junction of said one riser means and the lowest point of said immediately adjacent ramp means, and first abutment means having a height no greater than the height of said ramp means defines a front end of said recess, the base of said front end of said recess being spaced from the lowest point of said riser means by a distance at least as great as the thickness of the projecting portion of said document support means; and
said document support means abuts said one riser means and said front end of said recess when in said rearwardly leaning stable position to prevent said document support means from sliding along said ramp means.

46. A document storage and access case as defined in claim 45, including:
second abutment means which cooperates with said recess and is engageable with said document support means when said document support means is moved from said stable position to a forwardly leaning position, said second abutment means retaining said document support means in said forwardly leaning position;
whereby said document support means is tiltable between backwardly and forwardly leaning positions and is retained in both of said positions.

47. A document storage and access case as defined in claim 46, wherein:
said second abutment means comprises inwardly extending projections on said sidewall means; and
said document support means has outwardly projecting side flanges engageable with said second abutment means when said document support means is in said forwardly leaning position.

48. A document storage and access case as defined in claim 47 wherein:
said document support means engages an adjacent one of said inwardly extending sidewall projections when in said rearwardly leaning position to further retain said document support means in said stable position.

49. A document storage and access case as defined in claim 45, wherein:

said ramp means is integral with said bottom wall means of said housing.

50. A document storage and access case as defined in claim 45, wherein:

said recess includes a bottom wall defined by said bottom wall of said housing.

51. A document storage and access case as defined in claim 45, wherein:

said sidewall means includes a pair of sidewalls;

each of said ramp means includes a slot extending from the lowest point thereof to the highest point thereof, said slots in said ramp means being aligned; and a generally planar substantially rigid insert means is removably received in said slots;

whereby documents of one size may be supported on said plurality of inclined ramp means between one of said sidewalls and said insert means, and documents of another larger size may be supported on said plurality of inclined ramp means between said pair of sidewalls when said insert means is removed.

52. A document storage and access case as defined in claim 1 wherein:

said inclined ramp means form a part of an insert disposed within said housing.

53. A document storage and access case as defined in claim 52 including:

riser means forming a part of said insert and extending between the lowest and highest points of adjacent ones of said ramp means.

54. A document storage and access case as defined in claim 53 wherein:

said document support means is generally planar substantially rigid member disposed adjacent selected ones of said riser means.

55. A document storage and access case as defined in claim 54 including:

means for retaining said document support means in position adjacent selected ones of said riser means.

56. A document storage and access case as defined in claim 55 wherein:

said retaining means includes a plurality of aligned slots formed in said sidewall means for slidably receiving said document support means.

57. A document storage and access case as defined in claim 55 wherein:

said retaining means comprises a pair of generally planar inserts disposed adjacent opposed sidewall means;

each of said planar inserts including a plurality of slots for slidably receiving said document support means.

58. A document storage and access case as defined in claim 54 including:

a plurality of said document support means; and means securing each of said document support means to one of said riser means.

59. A document storage and access case as defined in claim 52 wherein:

each of said ramp means is inclined at an angle of between about 15° and about 35° relative to said bottom wall means; and each of said riser means is inclined at an angle of at least about 70° relative to said bottom wall means.

60. A document storage and access case as defined in claim 59 wherein:

each of said ramp means is inclined at an angle of about 30° relative to said bottom wall means; and each of said riser means is inclined at an angle of about 80° relative to said bottom wall means.

61. A document storage and access case as defined in claim 52 wherein:

said housing is generally rectangular in plan view with one pair of opposed sidewall means being shorter than the other pair of opposed sidewall means; and said insert is generally square in plan view and is adapted to rest on said bottom wall means with the peripheral edges disposed immediately adjacent said sidewall means.

62. A document storage and access case as defined in claim 61 wherein:

said insert defines a plurality of said inclined ramp means on both sides thereof, with riser means interconnecting the lowest and highest points of adjacent ones of said ramp means, whereby documents of one size may be supported on said plurality of inclined ramp means between one pair of opposed sidewall means and documents of another larger size may be supported on said plurality of ramp means when said insert is turned over and rotated 90°.

63. A document storage and access case as defined in claim 62 including:

means for retaining said document support means adjacent selected ones of said riser means including:

a first pair of generally planar inserts adapted to be disposed adjacent said one pair of opposed sidewall means, each of said generally planar inserts having slots aligned with selected ones of said riser means interconnecting said plurality of ramp means for slidably receiving and retaining in place said document support means; and a second pair of generally planar inserts adapted to be disposed adjacent said other pair of opposed sidewall means, each of said second pair of generally planar inserts having slots aligned with selected ones of said riser means interconnecting said plurality of ramp means for slidably receiving and retaining in place said document support means.

64. A document storage and access case as defined in claim 1 wherein:

said sidewall means defines a pair of sidewalls, a back wall extending between said sidewalls and a centrally disposed partial front wall; including:

handle means formed integrally with said case by sloping portions extending beyond the front edge of said bottom wall means towards said open top from either side of said partial front wall, and a cross member extending therebetween and spaced from said partial front wall; and additional sidewall means on either side of said sloping portions and said cross member.

65. A document storage and access case as defined in claim 64 including:

a cover member having substantially the same configuration as said housing and adapted to fit thereon, said cover member having an outwardly offset skirt portion formed along the free edge of the sidewalls thereof and adapted to fit over the peripheral edge of said housing sidewalls for providing a dust tight enclosure.

* * * * *